US005425536A

United States Patent [19]

Kelly et al.

[11] Patent Number: 5,425,536

[45] Date of Patent: Jun. 20, 1995

[54] ARCADE GAME

[75] Inventors: Matthew F. Kelly, San Ramon; Bryan M. Kelly, Dublin; Norman B. Petermeier, Saratoga; Joseph L. Tallarico, Livermore; Keven A. Heyes, Fremont; Jeffrey L. Allen, Pleasanton, all of Calif.

[73] Assignee: Lazer-Tron Corporation, Pleasanton, Calif.

[21] Appl. No.: 80,143

[22] Filed: Jun. 18, 1993

[51] Int. Cl.[6] ..... A63B 67/00

[52] U.S. Cl. ..... 273/115; 273/108; 273/113; 273/126 R; 273/126 A

[58] Field of Search ..... 273/108, 113, 115, 116, 273/118, 125, 126 R, 126 A, 129 R, 129 AP, 138 R, 138 A, 86 E

[56] References Cited

U.S. PATENT DOCUMENTS

| | | | |
|---|---|---|---|
| 1,364,632 | 1/1921 | Harrington . | |
| 1,531,783 | 3/1925 | Hampton . | |
| 2,087,198 | 7/1937 | Chambers . | |
| 2,400,261 | 5/1946 | Plebanek | 273/86 E |
| 3,452,987 | 7/1969 | Di Motta . | |
| 3,462,149 | 8/1969 | Grusin . | |
| 3,539,188 | 11/1970 | Salverda . | |
| 3,554,553 | 1/1971 | Hayashi . | |
| 3,787,055 | 1/1974 | Kraemer . | |
| 3,792,548 | 2/1974 | Hamano | 273/86 E X |
| 4,023,806 | 5/1977 | Wiser . | |
| 4,030,555 | 6/1977 | Boyce et al. | 273/110 |
| 4,055,344 | 10/1977 | Soucie . | |
| 4,173,341 | 11/1979 | Olliges | 273/126 A |
| 4,216,963 | 8/1980 | Boucher . | |
| 4,257,600 | 3/1981 | Goldfarb . | |
| 4,311,311 | 1/1983 | Crosman | 273/121 A |
| 4,332,385 | 6/1982 | McCaslin . | |
| 4,650,110 | 3/1987 | Geiger | 273/121 A |
| 5,048,832 | 9/1991 | Kaminkow | 273/119 A X |
| 5,064,196 | 11/1991 | Gottlieb | 273/126 A X |
| 5,066,014 | 11/1991 | Dobson | 273/120 R X |
| 5,110,128 | 5/1992 | Robbins | 273/126 A |
| 5,137,278 | 8/1992 | Schilling et al. | 273/119 A X |
| 5,161,801 | 11/1992 | Kazuk | 273/126 A |
| 5,255,916 | 10/1993 | Bleich | 273/118 R X |

*Primary Examiner*—Raleigh W. Chiu
*Attorney, Agent, or Firm*—Hickman & Beyer

[57] ABSTRACT

An arcade game including an inclined playing surface, a playing piece which can be directed down the playing surface, and a vibration apparatus operative to overcome the frictional forces between the playing piece and the playing surface. The vibration mechanism preferably includes motor-driven eccentrics, and the playing piece is preferably a fiat disc, such as a coin. The playing piece is preferably guided into target' apertures by manipulating a handle to vary the angle of the playing surface. A variation of the game includes an award dispenser, which dispenses an award based upon the game score. Another variation includes a progressive bonus apparatus which receives score contributions from at least one individual game unit.

43 Claims, 9 Drawing Sheets

70
MOTOR
84
120
MOTOR DRIVE
96
DRIVERS
118
TICKET DRIVE
112
TEST SWITCH
98
BUFFERS
114
COIN SWITCH
116
TILT MECHANISM
100
LATCHES
102
LAMP DRIVERS
122
88
RAM
ROM
90
μP
86
124
LATCH
87
104
OKI SOUND CHIP
92
LATCH
87
106
L.P.F.
94
SWITCHES
108
AUDIO AMP
SENSORS
95
SPEAKER
126
LATCH
24
36
066

ARCADE GAME

BACKGROUND OF THE INVENTION

1. Field of the Invention

This invention relates to games normally played in an arcade environment, and more particularly to such games played by directing a playing piece across a playing surface.

2. Background of the Related Art

Games of many types are played in arcade environments. One type of game utilizes a ramp and a playing piece that is directed down the ramp. A player can direct the playing piece into targets or around obstacles, and a game score is accumulated based upon the player's success.

U.S. Pat. No. 4,055,344, by C. Soucie, describes a game in which a disc is allowed to slide down a ramp through various obstacles in a maze. A player can rotate the entire maze to guide the disc toward target slots on the other end of the maze.

U.S Pat. No. 3,554,553, by K. Hayashi, describes a game in which a conically shaped playing piece is guided down an inclined plane through obstacles such as flags. The playing surface can be tilted in multiple directions to vary the path of the playing piece.

U.S. Pat. No. 3,462,149, by G. Grusin, describes a game in which discs are guided on a bi-level playing surface through apertures to a second level of the playing surface. The playing surface may be tilted to move the discs.

U.S. Pat. No. 1,364,632, by Harrington, describes a game in which a game board is pivoted about one end by a player to guide a spinning top to knock over obstacles provided on the game board.

Games of the prior art, while enjoyable, tend to be simplistic and, as such, can lead to rapid player boredom. This is undesirable in an arcade environment where revenues are directly related to the continuous, repeated use of the games.

SUMMARY OF INVENTION

The present invention provides an apparatus and method for playing a game comprising a playing surface and a playing piece to be guided along (usually down) the playing surface. The playing piece is preferably urged down the inclined playing surface by a vibration mechanism attached to the playing surface. A player can guide the playing piece using a handle mechanism that pivots the playing surface about a central axis. These improvements add excitement and complexity to the game, which tends to prolong player involvement.

An embodiment of the game apparatus of the present invention includes a playing surface, a playing piece which moves down the playing surface, a mechanism for vibrating the playing surface, and a user-controlled mechanism to alter the lateral angle of the playing surface. The playing piece is preferably a fiat disc, such as a coin, and the mechanism for vibrating the playing surface preferably includes a motor rotating offset weights.

The playing piece is preferably guided down the playing surface by a handle control that allows the player to rotate the playing surface about a central, longitudinal axis and thus direct the playing piece to either side of the playing surface. A player preferably rotates the playing surface manually and thus applies skill to the game. The playing piece is preferably guided into or around apertures and obstacles provided on the playing surface.

A variation of the game includes sensors operative to detect the passage of the playing piece through an aperture. A game score is preferably calculated by assigning each aperture an associated number, the value of which depends on the difficulty of guiding the playing piece into the associated aperture. The number score is credited to the player if the playing piece is guided into an aperture. A further variation of the game includes an award dispenser, which dispenses an award based upon the game score.

A further variation of the game includes a progressive scoring apparatus. One or more individual units of the present game apparatus are connected to the progressive scoring apparatus. As players operate individual game units, the units contribute numerically to a progressive display. When a player of a game unit accomplishes a predetermined task on an individual game unit, he or she receives an award based upon the progressive score. This bonus award adds excitement to the game.

The game apparatus according to the present invention includes a vibration apparatus that adds complexity and interest to an otherwise simple tilting game. This again increases player involvement with the game and increases the revenue produced by the game.

These and other advantages of the present invention will become apparent to those skilled in the art after reading the following descriptions and studying the various figures of the drawings.

DETAILED DESCRIPTION OF THE PREFERRED EMBODIMENTS

Figure 1:
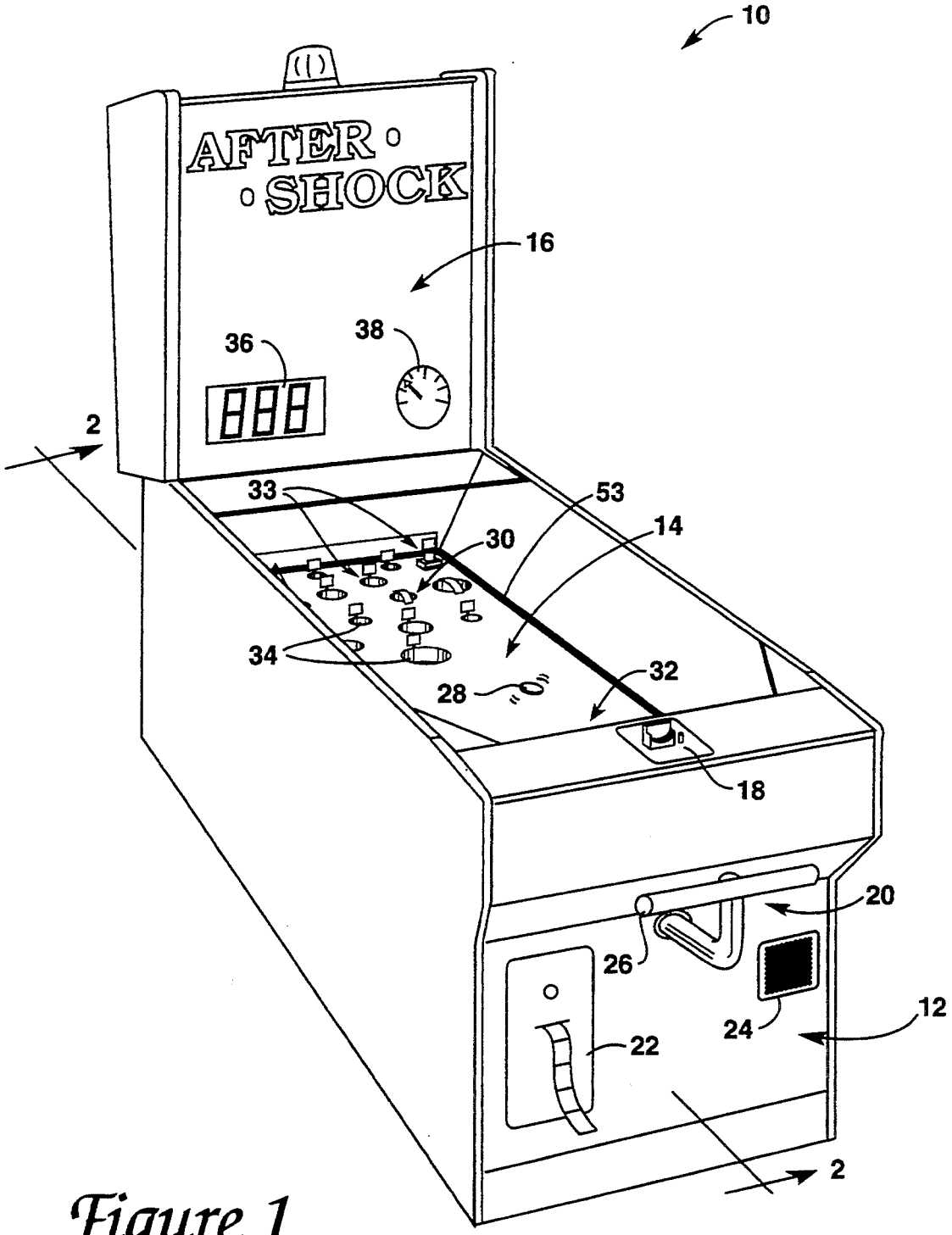
FIG. 1 is a perspective view of a game apparatus of the present invention.

FIG. 1 is a perspective view of a game apparatus in accordance with the present invention. The game apparatus 10 includes a front panel section 12, a playing surface 14, and a display section 16.

The front panel section includes a coin deposit slot 18, user control 20, a ticket dispenser 22, and a speaker 24. The coin deposit slot 18 may accept standard currency coins or game tokens that are often available in an arcade environment. In the present embodiment, a coin deposited in coin deposit slot 18 becomes the playing piece for the game. Alternately, coin deposit slot 18 may accept other types of discs suitable for use as playing pieces, or playing pieces can be released upon the playing surface in response to the deposit of a coin. Slot 18 can also be implemented as a hole or other aperture receptive to other forms of playing pieces, such as cones, cylinders, pyramids, cubes, or other shapes.

Handle 20 is preferably a metal bar bent upwardly with a grip 26. Handle 20 can pivot right (clockwise) or left (counterclockwise) and correspondingly pivots playing surface 14 to which it is attached. Handle 20 is described in more detail with reference to FIG. 2.

In alternate embodiments of the present invention, different control mechanism are employed. For example, a joystick can be used to pivot the playing surface using electric mechanisms (detailed with reference to FIG. 2*a*). In other embodiments, the playing surface 14 is angularly varied in other ways. For example, the playing surface can be tilted forward to back instead of side to side; or a section of the playing surface can be moved or tilted separately from the rest of the playing surface.

Ticket dispenser 22 preferably dispenses a ticket award to the player based upon a game score. In this present embodiment, tickets may be accumulated to win various prizes Other types of awards besides tickets may be chosen by the game owner; for example, baseball or other sports cards can be dispensed, or even coins or currency. Ticket dispensing mechanisms are well-known in the prior art. The awards are stored in a storage area behind the front panel 12 which is described in more detail with reference to FIG. 2.

The speaker 24 emits sounds based on game actions and other game states and is controlled by the game unit controller system. The operation of the speaker will be discussed in greater detail subsequently.

In embodiments where playing pieces other than coins or game tokens are used, the front panel 12 of game apparatus 10 includes a playing piece dispenser. Such a dispenser provides a playing piece for the player's use and includes a playing piece return apparatus behind front panel 12 which returns the playing piece to the dispenser after the game has been played. Such apparatus are well known to those skilled in the art. In such an embodiment, coin slot 18 accepts coins for immediate storage in a coin box and dispenses a playing piece when a coin is inserted.

Figure 3:
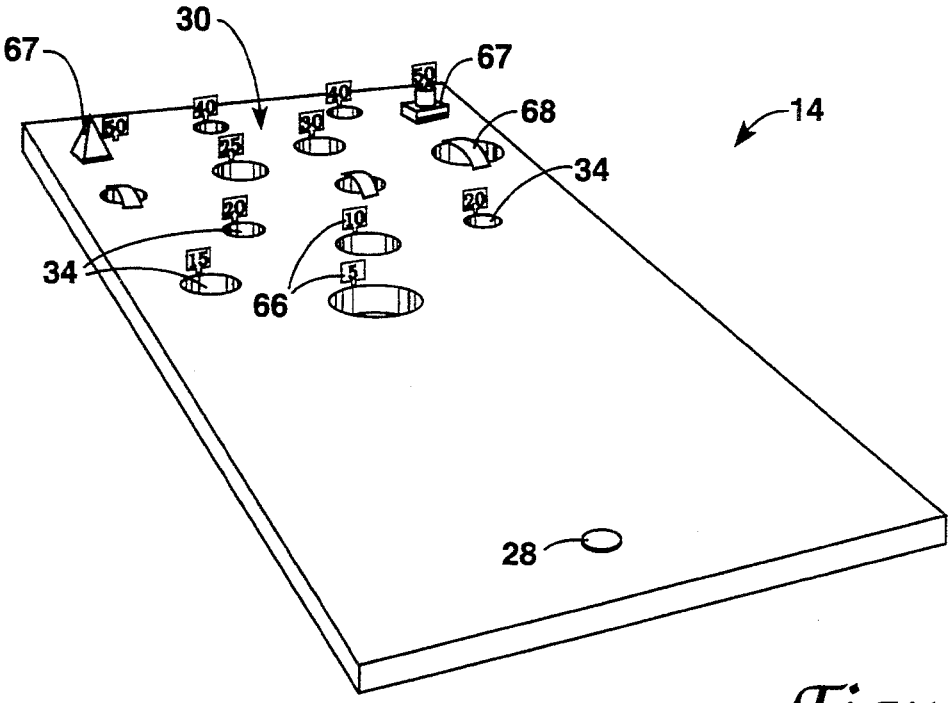
FIG. 3 is a perspective view of a playing surface of the present invention.

The playing surface 14 is shown in FIGS. 1 and 3 and includes a far end 30 and a near end 32. In the preferred embodiment, the surface 14 is a substantially planar ramp where the far end 30 is lower than the near end 32. The near end 32 is positioned below the coin slot 18 through which the player inserts a playing piece onto the playing surface 14. The playing piece is preferably a coin 28 that travels down the playing surface 14 from the near end to the far end (described in detail subsequently). The playing surface 14 is preferably a smooth surface; but it can also be a rough or contoured surface (described with reference to FIG. 3).

The far end 30, in the preferred embodiment, includes a number of obstacles 33 that are operative to alter the movement or pathway of the playing piece. In the preferred embodiment, the obstacles 33 include apertures 34 into which coin 28 may fall. The apertures are described in more detail with reference to FIG. 2. In other embodiments, obstacles such as walls, hoops, figures, etc. are also provided.

The display section 16 includes a game score display 36 and a progressive bonus indicator 38. The game score display 36 is an LED display that indicates a game score to the player. Progressive bonus indicator 38 displays the player's status in the game relative to achieving the progressive bonus award. The progressive bonus indicator is incremented when the player accomplishes a predetermined task in the game (explained in more detail with reference to FIG. 9).

Figure 2:
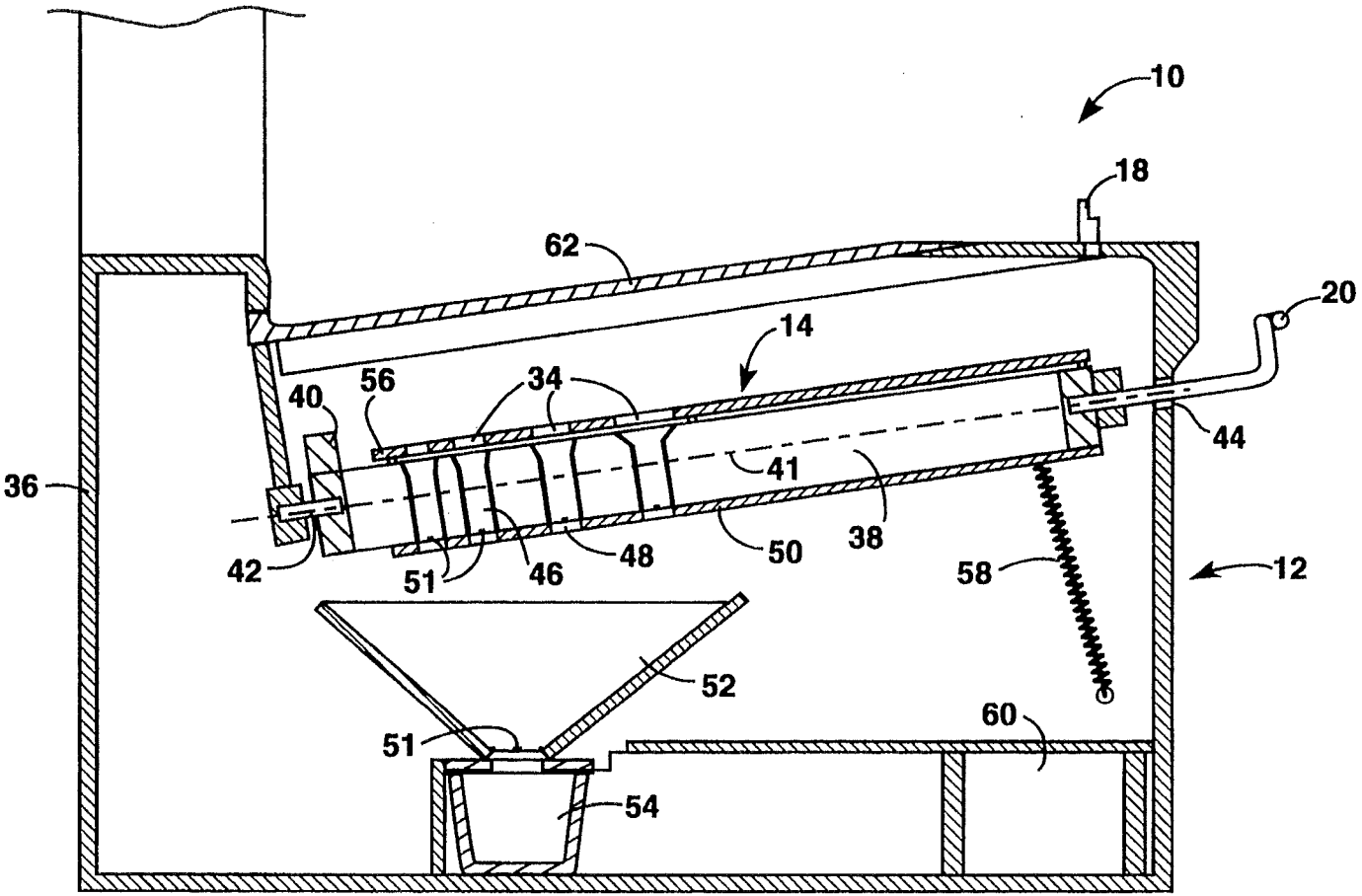
FIG. 2 is a partial side cross-sectional view taken along line 2—2 of FIG. 1.

FIG. 2 is a cross-sectional view of the game apparatus 10. Game cabinet 36 supports the playing surface 14 and front panel 12. Playing surface 14 is positioned on a support frame 38 that rotates about axis 41. Support frame 38 is rotated around axle 42 positioned at the obstacle end 30 of the playing surface 14. Support frame 38 is also attached to and rotates with handle 20, which includes an axle that extends through hole 44 provided in the front panel 12. Support frame is preferably rigidly attached to handle 20 so that it will rotate that same amount as handle 20. In other embodiments, support frame 38 can rotate according to a predetermined relationship with handle 20; for example, a $\frac{1}{2}$ turn with the handle could rotate the support frame $\frac{1}{4}$ turn, etc., thereby giving finer control to the user.

A coin 28 is deposited by a player through slot 18. The coin drops onto playing surface 14 and travels down the playing surface. The coin may then fall into an aperture 34 provided in the playing surface 14. If a coin falls into an aperture 34, it preferably travels through a funnel 46 and out through a hole 48 provided in a base member 50. Each aperture 34 is preferably provided with an associated funnel 46 and hole 48. As a coin travels through a funnel, it is preferably detected by a suitable sensor, such as a sensor 51 detailed with reference to FIG. 6.

A coin that falls through a hole 48 preferably drops down to collection funnel 52, which directs all coins into a central coin box 54. The collection funnel 52 is large enough to receive coins fallen from any aperture or off the side of the playing surface 14. Preferably, a sensor 51 is provided at the base of the collection funnel 52 to detect the passage of all coins directed into coin box 54. Coin boxes suitable for use in game unit 10 are readily available on the commercial market.

In the preferred embodiment, if a coin does not fall into an aperture 34, it can instead fall off one of the edges of playing surface 14. Space 53 (see FIG. 1) is preferably provided around the playing surface 14 allowing the coin to fall from the surface to a lower elevation. A coin 28 that falls off the edge is caught by collection funnel 52 and guided to coin box 54. A coin that travels to back edge 56 of playing surface 14 first impacts a stop 40 and then drops through support frame 38 to collection funnel 52 and coin box 54.

Spring 58 connects the two front corners of the support frame 38 to the sides of the game cabinet 36.

Springs 58, which are provided to urge playing surface 14 to a neutral position, are detailed with reference to FIG. 5.

Award dispenser box 60 is positioned close to front panel 12. Awards dispensed by the dispenser 22 are preferably stored in the box 60. Game apparatus 10 preferably includes protective glass 62 which prevents the player from interfering with game play and reduces noise from the vibrating playing surface (explained with reference to FIG. 4).

Figure 2A:
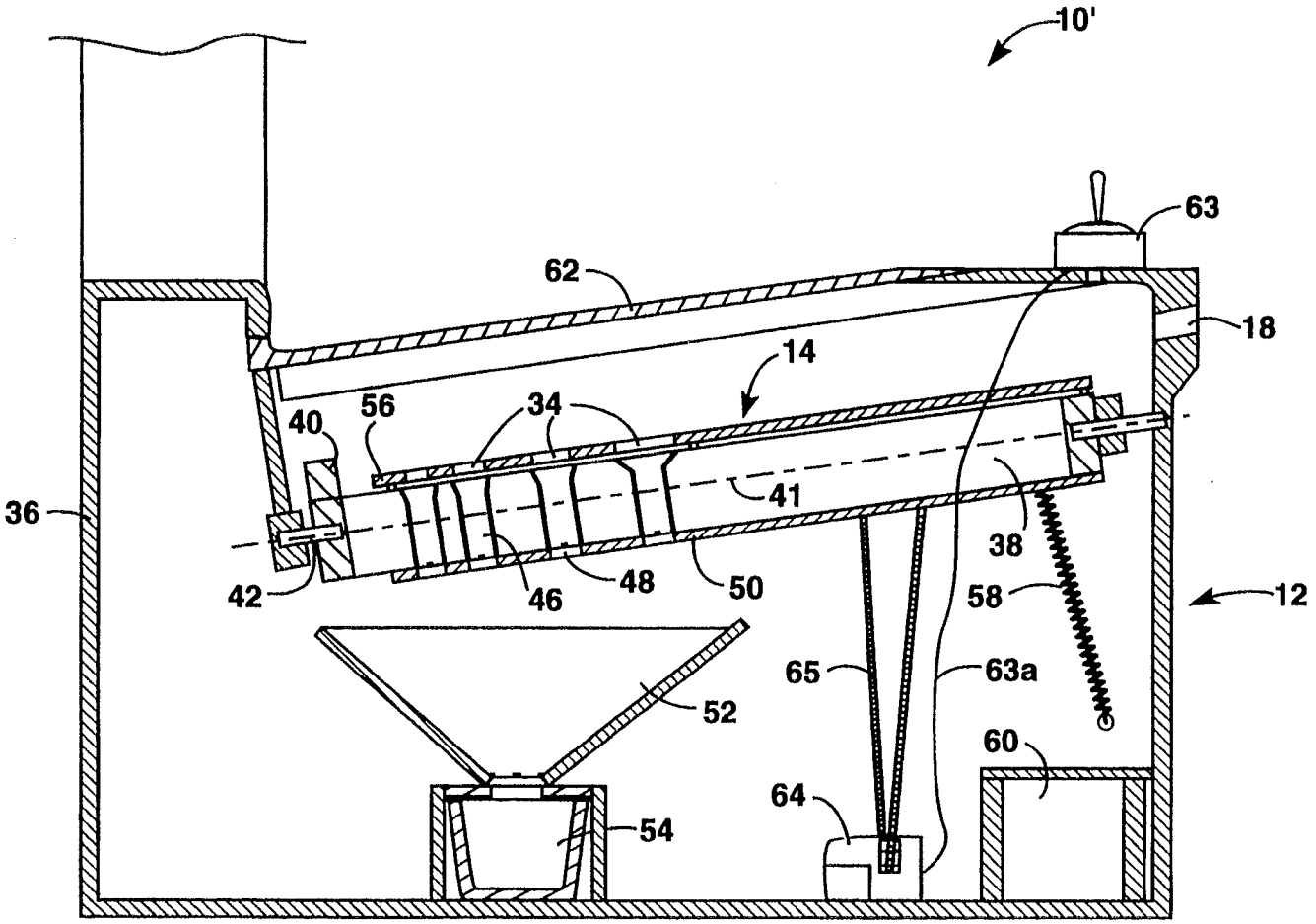
FIG. 2*a* is a partial cross-sectional view similar to that of FIG. 2 of an alternate embodiment of a game apparatus according to the present invention.

FIG. 2*a* shows an alternate embodiment of game apparatus 10' that includes an electronic mechanism to pivot support frame 38 and playing surface 14. Elements of FIG. 2*a* which are similar to elements of FIG. 2 use the same reference numbers. In this alternate embodiment, controller 63 includes a joystick that develops an electrical signal indicating the direction in which it is pushed. A motor 64 is electrically coupled to controller 63 by a data line 63*a* and receives the electrical signals from the controller. Chain 65 connects the motor 64 to support frame 38. Chain 65 is connected at a first end to the right side of support frame 38, engages a gear coupled to a shaft of motor 64, and is connected at a second end to the left side of support frame 38. Motor 64 is operative to move chain 65 by rotating a gear either clockwise or counterclockwise in response to electrical signals from controller 63. As chain 65 is moved, support frame 38 pivots about axis 40 on axle 42 and an axle 43. Playing surface 14 pivots with support frame 38.

FIG. 3 is a perspective view of playing surface 14. As a coin moves toward far end 30 it may fall into any of the apertures 34, each of which preferably includes a display 66 indicating by how much the game score is incremented if coin 28 falls into that aperture. Apertures 34 are preferably of different sizes; the smaller the aperture, the greater the degree of difficulty in guiding the coin into the aperture, and the greater the point number assigned to that aperture. Obstacles 67 partially block some apertures 34 and are provided with slots into which coin 28 can be guided. Since the obstacles provide a smaller target for coin 28, a higher point total can be added to the game score if coin 28 is guided through them. Other obstacles can be provided on playing surface 14, such as pins, walls, ramps, etc.

Playing surface 14 may also include pathways 68, which provide a confined route for coin 28 for added game difficulty and an increased game score. For example, if coin 28 is guided over a bridge positioned over an aperture 34, a higher score can be given if the coin 28 is guided into an aperture 34 right after the coin crosses the bridge.

Playing surface 14 may be contoured in other embodiments. Coin 28 can be guided over hills, valleys, channels, etc. The playing surface can also be varied in texture so that some areas are rough or textured with a pattern to provide more or less difficulty in guiding a playing piece over the playing surface 14.

Figure 3A:
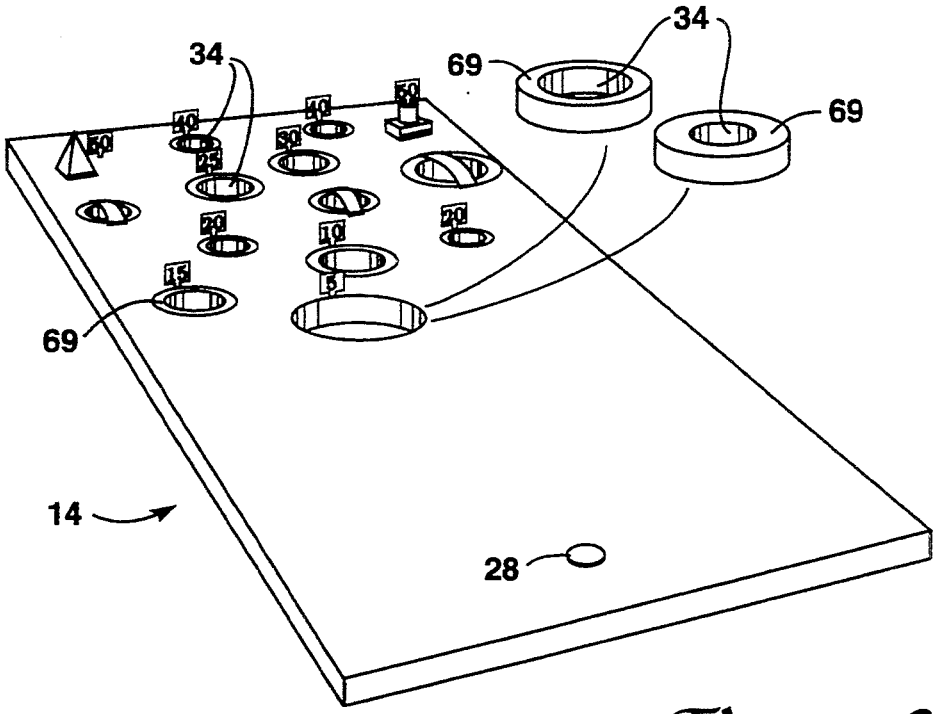
FIG. 3*a* is a perspective view of an alternate embodiment of a playing surface.

FIG. 3*a* shows an alternate embodiment of playing surface 14 used in accordance with the present invention. In this embodiment, an aperture 34 is provided in module 69 which may be inserted into playing surface 14. Different modules can be provided in which the size of the aperture 34 differs but the outer diameter of the module 69 remains constant. Differently-sized apertures can thus be placed in playing surface 14 by the game operator to control the difficulty of the game or to conform the size of the apertures to larger or smaller coin (or other playing piece) sizes that may be used in different gaming environments. Point scores associated with the modules can likewise be modified by the operator.

Figure 4:
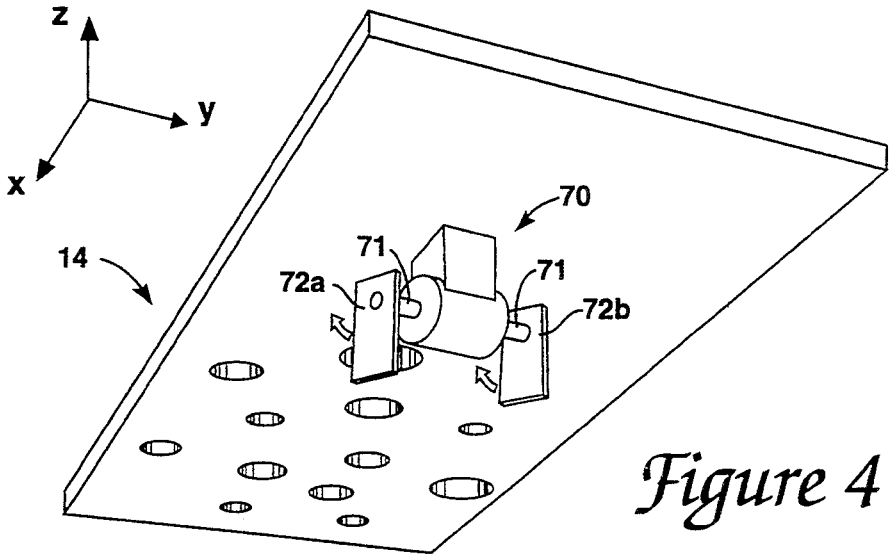
FIG. 4 is a perspective view of a preferred vibration mechanism of the present invention.

FIG. 4 is a bottom perspective view of the playing surface 14. A vibration apparatus 70 is preferably positioned near the center of the bottom of playing surface 14. In the preferred embodiment, vibration apparatus 70 includes a motor operative to spin off-center cam weights element 72*a* and 72*b* attached to the shaft 71 of the motor. Offset elements 72*a* and 72*b* can be implemented as eccentrics. The rotations per minute (RPM) of shaft 71 of motor 70 is controlled by an electronic control system described with respect to FIG. 7.

Motor 70 induces a displacement force, i.e. a vibration, in playing surface 14 in order to impart a displacement force on coin 28 and urge coin 28 from the near end 32 to the far end 30 of the playing surface 14. Herein, a "displacement force" is a force able to urge a playing piece from near end 32 to far end 30 of playing surface 14. This is preferably accomplished by producing a cyclic vibration in the playing surface which is sufficient to overcome the frictional forces between the coin 28 and the playing surface 14. Since the coin is already moving when it contacts the playing surface due to the force of dropping from the coin slot to the playing surface, the vibration must typically only overcome the dynamic friction force between the coin and the surface to propel the coin down the playing surface. A gravitational force caused by the incline in the ramped playing surface also assists coin 28 in moving from player end 32 to obstacle end 30.

In other embodiments, the playing surface 14 is substantially flat, and the vibration source and the pivoting of the playing surface by the player can be the major forces propelling the coin. In such an embodiment, a textured surface or obstacles can provide the guidance necessary to propel the coin from one side of the playing surface to another; the vibration force is preferably greater than the static friction force between the coin and the playing surface in such an embodiment. In further alternate embodiments, the playing surface 14 is inclined in an upwards direction, so that far end 32 is higher than near end 30. In such an embodiment, the motor 70 induces vibration in playing surface 14 to overcome the static friction force between the coin 28 and the playing surface 14 and the vibration wave carries the coin 28 "uphill".

The vibration induced in the playing surface from motor 70 is adjusted to provide sufficient challenge to the game. For example, enough vibration should be provided to make it difficult to guide coin 28 the smaller apertures 34. On the other hand, too much vibration in playing surface 14 can cause the coin 28 to bounce wildly, move too quickly, or otherwise become uncontrollable. Preferably, the correct amount of vibration is induced in playing surface 14 which causes coin 28 to vibrate (or "buzz") down the playing surface, instead of bounce. In practice, it has been found that a playing piece with flat edges, such as a coin, can be accurately guided on a vibrating playing surface.

In selecting the degree of vibration induced in playing surface 14, a number of factors should be taken into account. The playing surface 14 is preferably made of a material that is both stiff and flexible. Preferably, wood such as particle board or a steel sheet is used for the playing surface 14. The materials, size, and shape of playing surface 14 can be adjusted for a particular vibration frequency to optimize the desired speed and characteristics of coin 28 as it travels down the playing surface.

By causing coin 28 to vibrate and not bounce, the resonant frequency of the playing surface can be matched to the resonant frequency of the coin 28 by selecting proper materials for the playing surface. The resonant frequency of the entire playing surface, including surface material, apertures, and springs connecting the playing surface to the support frame 38 (described in detail with reference to FIG. 5), can also be matched to the resonant frequency of coin 28.

In the preferred embodiment, a control system (detailed with reference to FIG. 7) is used to control the motor 70 and the vibration induced in playing surface 14. Several vibration settings can be programmed into the control system so that a game operator can quickly and easily change the rate of vibration and thus the difficulty of the game.

Using the motor 70 of the preferred embodiment, the amount of vibration in playing surface 14 is directly related to the rotation speed of the offset elements 72*a* and 72*b*. The rotating offset elements effectively create sinusoidal waves through the playing surface 14. The faster the weights are rotated, the higher the frequency of the sinusoidal waves, thus causing the frequency of the vibration to increase. The amount of vibration can thus be controlled to a fine degree by controlling motor speed. The coin 28 is vibrated but still controllable within a certain range of rotation speeds of the offset elements 72*a* and 72*b*. The vibration can also be controlled by offsetting the elements from the central shaft to a greater degree or by changing the length of the offset elements to provide a sinusoidal wave of greater amplitude with each rotation.

The offset elements 72*a* and 72*b* cause a vibration along the z-axis direction in playing surface 14. In order for coin 28 to move effectively, vibration along the x- and y-axes is also desired. To cause vibration along the x- and y-axes, one of the offset elements is preferably heavier than the other. As the offset elements spin, the difference in weight on either side of motor 70 causes a rocking motion and a vibration in playing surface 14 along the x- and y-axes. Offset elements 72*a* is preferably made of aluminum, and offset elements 72*b* is preferably made of steel.

Thus, using the motor 70 as described above, two parameters of vibration, frequency and amplitude, can be controlled in playing surface 14. The frequency of the vibration can be controlled by adjusting the speed of the motor 70; and the amplitude of the vibration can be controlled by altering the sizes of offset elements 72*a* and 72*b*, or by changing the position of the offset elements on shaft 71.

More than one motor 70 can be used to create a desired vibration effect in playing surface 70. A motor 70 can be placed at specific locations along playing surface 14 to cause a greater vibration to be induced in specific areas of the playing surface and increase or decrease game difficulty as desired.

A cyclic, automatic force, such as vibration, can be induced in playing surface 14 using other types of mechanisms. For example, several solenoids controlled by an oscillator can be placed along the playing surface and used to vibrate the playing surface at a particular frequency. In a different embodiment, an electromagnet coupled to an oscillator is used to increase or decrease attraction between ferromagnetic materials coupled to playing surface 14 to cause a vibration in playing surface 14.

Figure 4A:
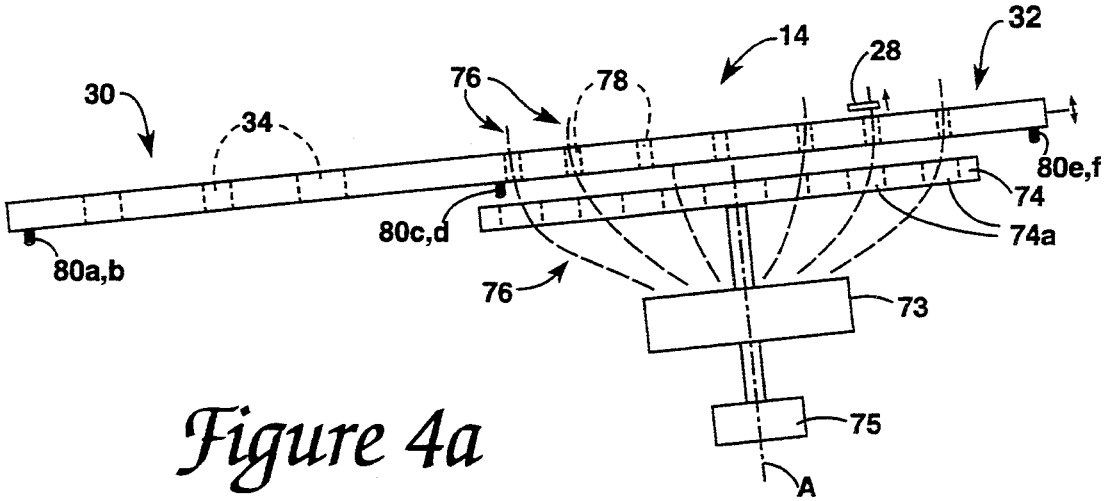
FIG. 4*a* is a side elevational view of an alternate vibration mechanism of the present invention.

FIG. 4*a* shows another embodiment of the present invention in which a fan 73 is positioned underneath the playing surface 14. Fan 73 is preferably a "squirrel-cage" type fan having a central opening. Fan 73 forces air 76 upwardly through holes 74*a* provided in a rotating disc 74. Disc 74 rotates about axis A on a shaft of motor 75 positioned below fan 73; the shaft extends through the central opening of fan 73. As disc 74 rotates, air 76 flows through air holes 78 provided in playing surface 14 whenever holes 74*a* are aligned with corresponding air holes 78. Air holes 78 are small enough to prevent substantial interference with the movement of playing piece 28 down the inclined surface of playing surface 14. Air 76 thus travels up through air holes 78 at various times depending on the configuration of holes 74*a* in disc 74. The air causes vibration in playing surface 14 (which is supported by springs 80*a–f*) also imparts force on coin 28. The vibration is due to the fact that the air exerts a greater pressure on the playing surface 14 when the holes 74*a* of the disc 74 are not aligned with corresponding holes of the playing surface 14, and less pressure on the playing surface 14 when they are substantially aligned. The air 76 pushes coin 28 upwardly whenever coin 28 travels over an air hole 78 through which air 76 is flowing. Coin 28 also is influenced by gravity to travel down the incline of playing surface 14 from near end 32 to far end 30. The coin thus is urged by air 76, vibration in playing surface 14, and gravity until coin 28 reaches the middle area of the playing surface; from this point, gravity, vibration and the coin's momentum urge the coin down the remaining portion of the playing surface 14. Other air displacement apparatus can also be used, such as air valves connected to holes 78 and hooked up to a compressor and a computer at the opposite end to allow air to flow through holes 78 at programmed intervals.

Figure 5:
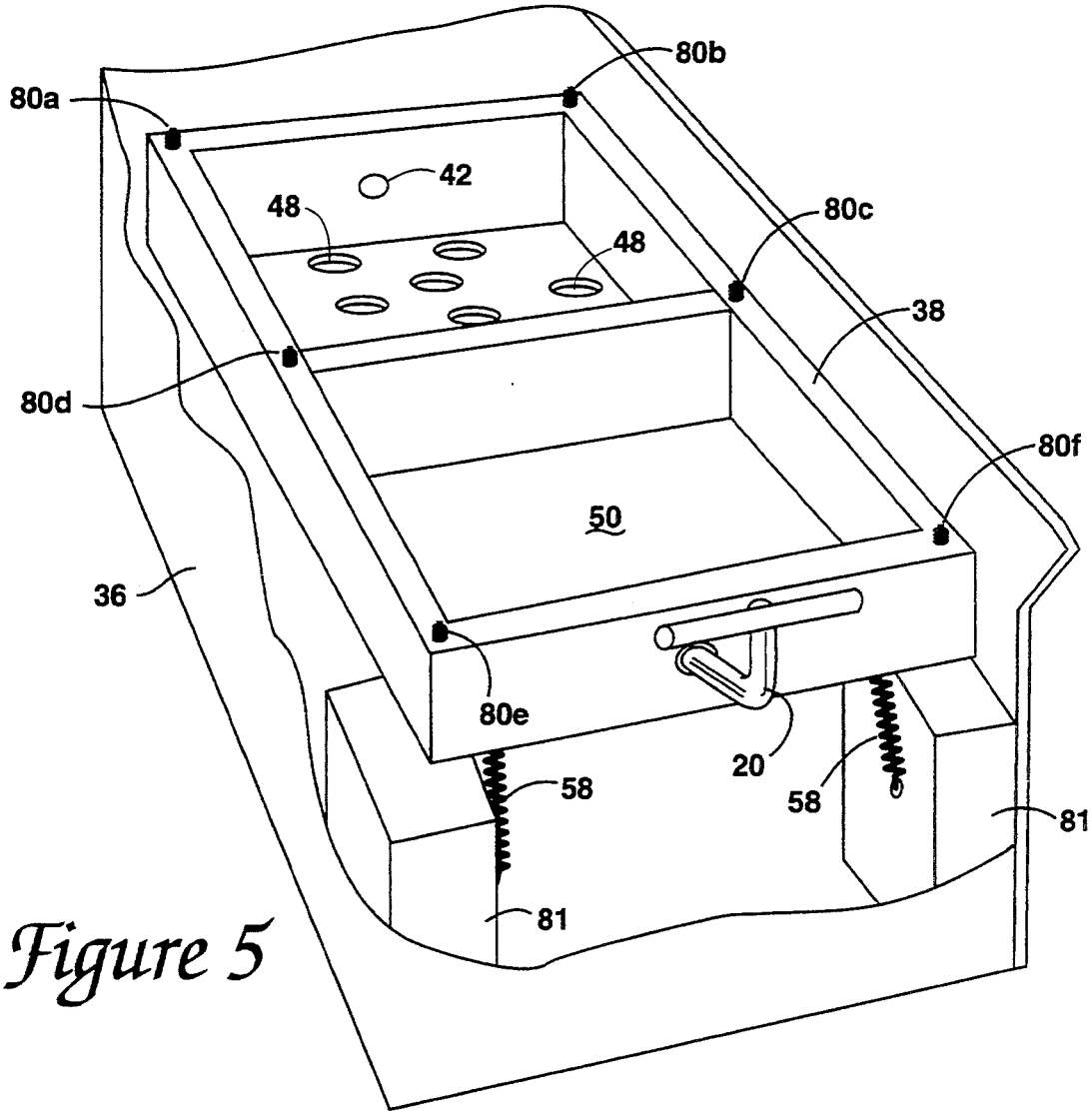
FIG. 5 is a perspective view of a playing surface frame and support frame of the present invention.

FIG. 5 shows the support frame 38 attached to game cabinet 36 with playing surface 14 removed. Support frame 38 is preferably constructed of several studs with empty space in between to accomodate holes 48. Holes 48 are provided in base member 50 and are connected to corresponding apertures 34 of playing surface 14 through funnels 46 (shown in FIG. 2). Playing surface 14 is preferably attached to support frame 38 by springs 80*a–f*, which are positioned along the sides and corners of support frame 38. Springs 80*a–f* function to reduce vibration in the support frame 38, game cabinet 36, and attached components so that only playing surface 14 is substantially vibrating. Springs 80*a–f* also influence how much coin 28 vibrates on playing surface 14 and how fast coin 28 travels down the playing surface for a particular rotation speed of motor 70. The springs 80*a–f* can also be varied in tensile strength to provide different amounts of vibration to different sections of the playing surface 14. In the preferred embodiment, springs 80*a* and 80*b* are less stiff than springs 80*c–f* so that far end 30 of playing surface 14 vibrates to a greater degree, causing coin 28 to travel faster at end 30 and increasing the challenge of the game.

Springs 58 are attached between the bottom of the support frame 38 and side walls of the game cabinet 36. Springs 58 preferably center support frame 38 in its standby (i.e. untilted or unpivoted position) position after the handle 20 has been released by a player. Playing surface 14 is thus always positioned facing upwards (i.e. at a zero lateral angle) when no force is imparted on handle 20.

Stops 81 are preferably wooden blocks positioned to block the edges of support frame 38 when frame 38 is pivoted a predetermined number of degrees in either direction. Stops 81 prevent support frame 38 from pivoting more than a desired amount to control the degree to which a player can guide coin 28 down the ramp and to control possible abuses to support frame 38 from players.

Figure 6:
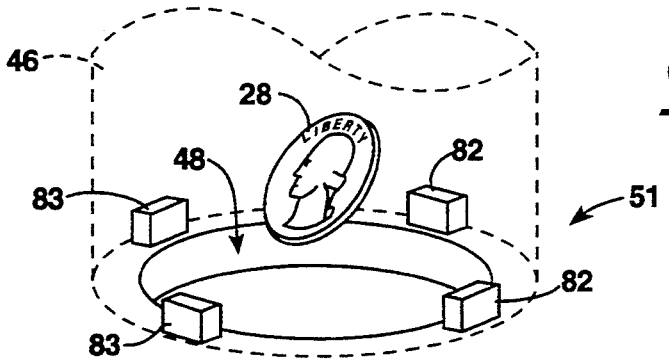
FIG. 6 is a side elevational view of an optoelectronic sensor of the support frame.

FIG. 6 is a detailed view of a sensor 51 that is located in a funnel 46 and main funnel 52. In the preferred embodiment, a sensor 51 includes two emitters 82 and two detectors 83 positioned 90 degrees apart around hole 48 at the bottom of funnel 46. Emitters 82 transmit a beam of electromagnetic energy, such as infrared light, across hole 48 to an opposing detector 83, which continually receives and detects the beam. If coin 28 fails through an aperture 34 and hole 48, it breaks one or both beams projected from emitters 82, and one or both detectors 83 sense that a beam has been broken. A detector 83 sends a signal to a control system (described below) indicating that a beam has been broken.

In other embodiments, different types of sensors can be used. For example, a Hall effect switch can be used, which can sense metallic materials (as used in a coin) using a magnetic apparatus. In other embodiments, if a large playing piece is guided into an aperture, a switch positioned in funnel 46 can detect the passage of the playing piece if the playing piece contacts the switch.

Figure 7:
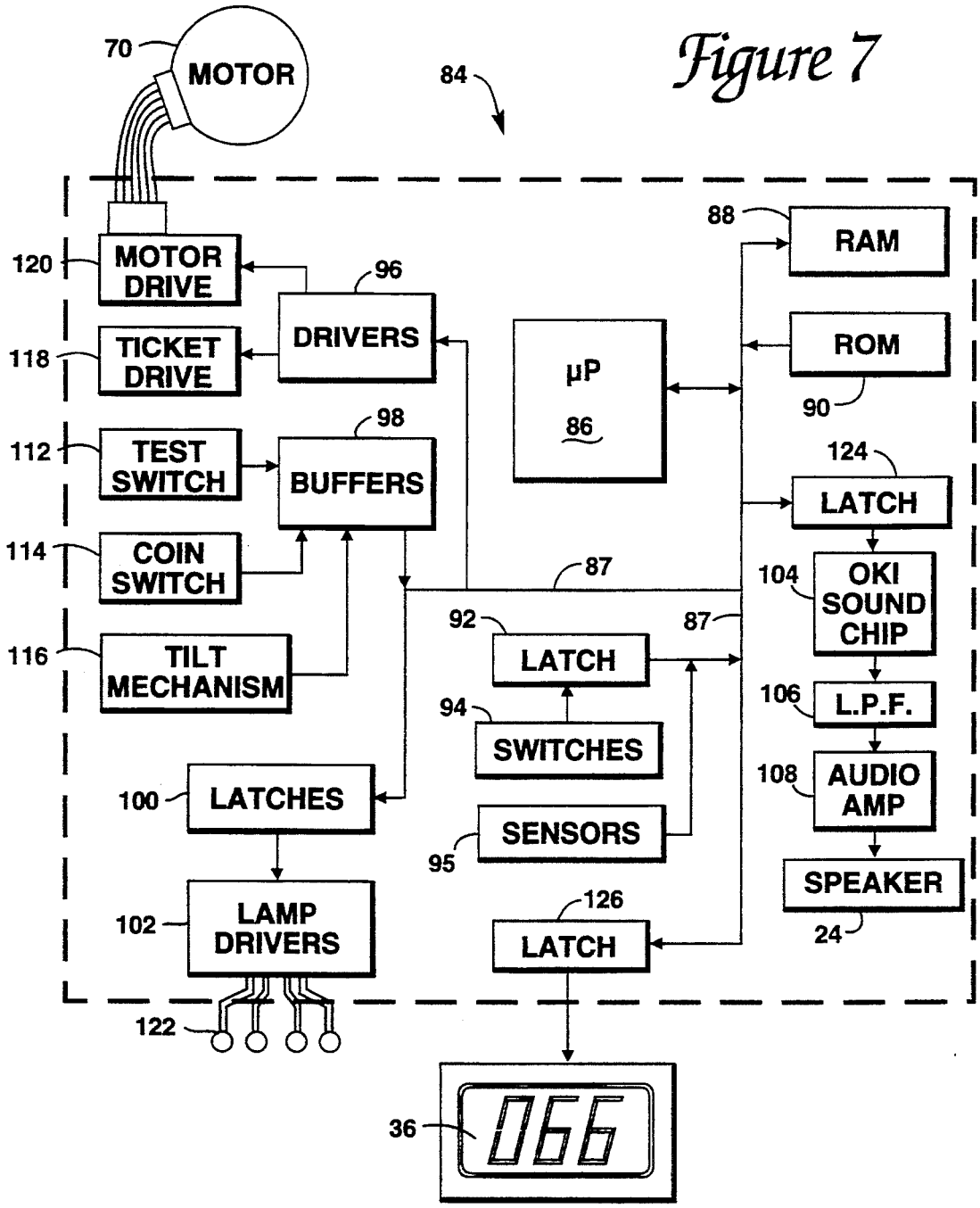
FIG. 7 is a block diagram of an electronic control circuit of the game apparatus.

FIG. 7 is a block diagram of a control system 84 of game apparatus 10; for example, a printed circuit board including the control system can be located behind the display section 16. The components of control system 84 include a microprocessor 86, RAM 88, ROM 90, a latch 92, DIP switches 94, drivers 96, buffers 98, latches 100, lamp drivers 102, sound chip 104, low pass filter 106, audio amplifier 108, and speaker 24. The control system 84 is coupled to game score display 36 and a motor 70.

The microprocessor 86 is preferably an 8-bit microprocessor, such as the Intel 8031, which has the range of features adequate for the task, including eight data lines and sixteen address lines. The microprocessor 86 is coupled to ROM 90 by a data/address/control bus 87. The ROM 90 is preferably an erasable, programmable read-only memory (EPROM) that contains the start-up instructions and operating system for the microprocessor 86. Microprocessor 86 is connected to RAM 88 by bus 87 to permit the use of RAM for scratch-pad memory. Methods for coupling ROM 90 and RAM 88 to the microprocessor 86 by bus 87 including enable, address, and control lines are well-known to those skilled in the art.

The microprocessor 86 is also coupled to a latch 92 by the bus 87. The switches 94 coupled to latch 92 provide selectable functions that the operator of the game unit may change to his or her liking. These selectable functions include the values of the target apertures in terms of game score, sound effects, progressive jackpot value (if present), the amount of any award given, the test mode, the type of game, and so on. Other selectable functions can also be set by the switches depending on how many selectable game options and features are desired. The sensors 51 coupled to latch 92 are located in the funnels 46 and main funnel 52 operative to detect the passage of a playing piece through the funnels, as detailed in FIGS. 2 and 6.

The microprocessor 86 is also coupled to the drivers 96 and the buffers 98. The buffers 98 receive data from several switches, including the test switch 112, which activates a test mode for the game apparatus 10; the coin switch 114, which detects if a coin has been inserted into the coin slot 18 of the front panel 12; and the tilt mechanism 116, which detects if the game apparatus 10 has been tilted too far to one side by a player, and are well known in the art. In embodiments including a playing piece dispenser, a playing piece release switch (not shown) can be coupled to buffers 98, which indicates to the microprocessor 86 if a playing piece has actually been dispensed to the player.

The drivers 96 activate output devices including the ticket drive 118, which activates the dispensing of the award (in this case, tickets) out of the award dispenser 22; and the motor drive 120, which provides control signals to the motor 70 for vibrating the playing surface 14. In the preferred embodiment, these control signals include a square wave that is output using pulse width modulation techniques. The square wave is varied in frequency to change the speed of rotation of motor 70 to achieve the desired amount of vibration.

The microprocessor 86 is also coupled to latches 100 which latch data for the lamp drivers 102. The lamp drivers 102 supply power to the lamps 122, which include lights on the display section 16 and along playing surface 14 of the game apparatus 10 that are not part of the game score display 36 or progressive bonus indicator 38. In the preferred embodiment, components such as the motor 70, award dispenser 22, and lamps 122 are powered by a commercially available 110 V AC power supply and power converters, which are well known in the art.

The microprocessor 86 is also coupled to a sound chip 104 which can be, for example, an OKI Voice Synthesis LSI chip available from OKI Semiconductor of San Jose, Calif. that has eight data input lines coupled to the microprocessor 86 by a latch 124. The sound chip 104 can receive its data from ROMs (not shown) and preferably outputs sound data to a low pass filter 106, an audio power amplifier 108, and finally to the output speaker 24, which generates sounds to the player playing the game apparatus 10.

The microprocessor 86 is also coupled to game score display 36. The bus 87 connecting the microprocessor 86 to the score display 36 is latched by a latch 126. The game score display is preferably a 7-segment LED digit display. Progressive bonus indicator 38 can similarly be controlled by bus 87 and latch 126.

The preferred embodiment of the control system 86 operates briefly as follows. The microprocessor 86 first reads the low memory from ROM 90 over bus 87 and sequences through the software instructions stored in ROM. The settings of DIP switches in the switches block 94 are also read into the microprocessor. The software from the ROM 90 then instructs the microprocessor 86 to send and receive data over the bus 87 in order to conduct a game. For example, when the coin switch 114 is activated, indicating a coin has been inserted into coin slot 18, the microprocessor reads a signal from the buffers 98 on bus 87. The microprocessor then sends a pulse-width modulated signal to the drivers 96 and motor driver 120 in order to start and alter the vibration of the playing surface and propel the coin down the playing surface at a desired vibration level. The microprocessor then awaits a signal from sensors 51 that indicate which aperture 34 the coin 28 fell into. The specific sensor 51 signal determines how the microprocessor will modify the game score total. The microprocessor updates the score display by sending a signal to score display 36. The microprocessor also awaits data from sensor 51 positioned in main funnel 52, which indicates that the coin has fallen into the coin box 54 and the game is over. Once the game is over, the microprocessor awaits another signal from coin switch 114 indicating another coin has been deposited in coin slot 18. During game play, the microprocessor sends appropriate output signals over bus 87 to activate speaker 24 and lamps 122 whenever game action occurs, such as when a coin fails into an aperture or collides with an obstacle.

The operation of the preferred embodiment of the game apparatus may be briefly described as follows: A player deposits a coin or token into coin slot 18 of game apparatus 10 to start the game. Coin 28 fails onto playing surface 14 and is guided through pins 63. The microprocessor starts the motor 70, which vibrates the playing surface 14 and causes the coin to travel down the playing surface at a faster rate. The player directs the coin 28 in a desired direction by pivoting the playing surface with handle 20. If the coin falls into a target aperture 34 positioned in the playing surface 14, the coin fails through a funnel 46, where it is detected by sensor 51, and down to a main funnel 52 which guides the coin to a coin box 54. Meanwhile, the sensor 51 sends a signal to the microprocessor and the microprocessor adjusts the score accordingly. The main funnel sensor also sends a signal to the microprocessor indicating that the game is over.

If the coin did not fall into a aperture 34, it must have fallen off one of the sides of playing surface 14. The coin fails directly into main funnel 52, and the sensor located therein sends a signal to the microprocessor indicating that the game is over.

Once the game is over, the microprocessor activates award dispenser 22 to dispense an award based upon the game score. For example, if the final game score is 20, 20 tickets could be dispensed to the player.

The player can continue to insert coins and play the game in this manner. In an alternate embodiment, the microprocessor starts a timer after a game is over. If a player inserts another coin before the time limit has passed, the present game score can be added to the previous game score to determine if a progressive bonus award should be dispensed (described below).

Figure 8:
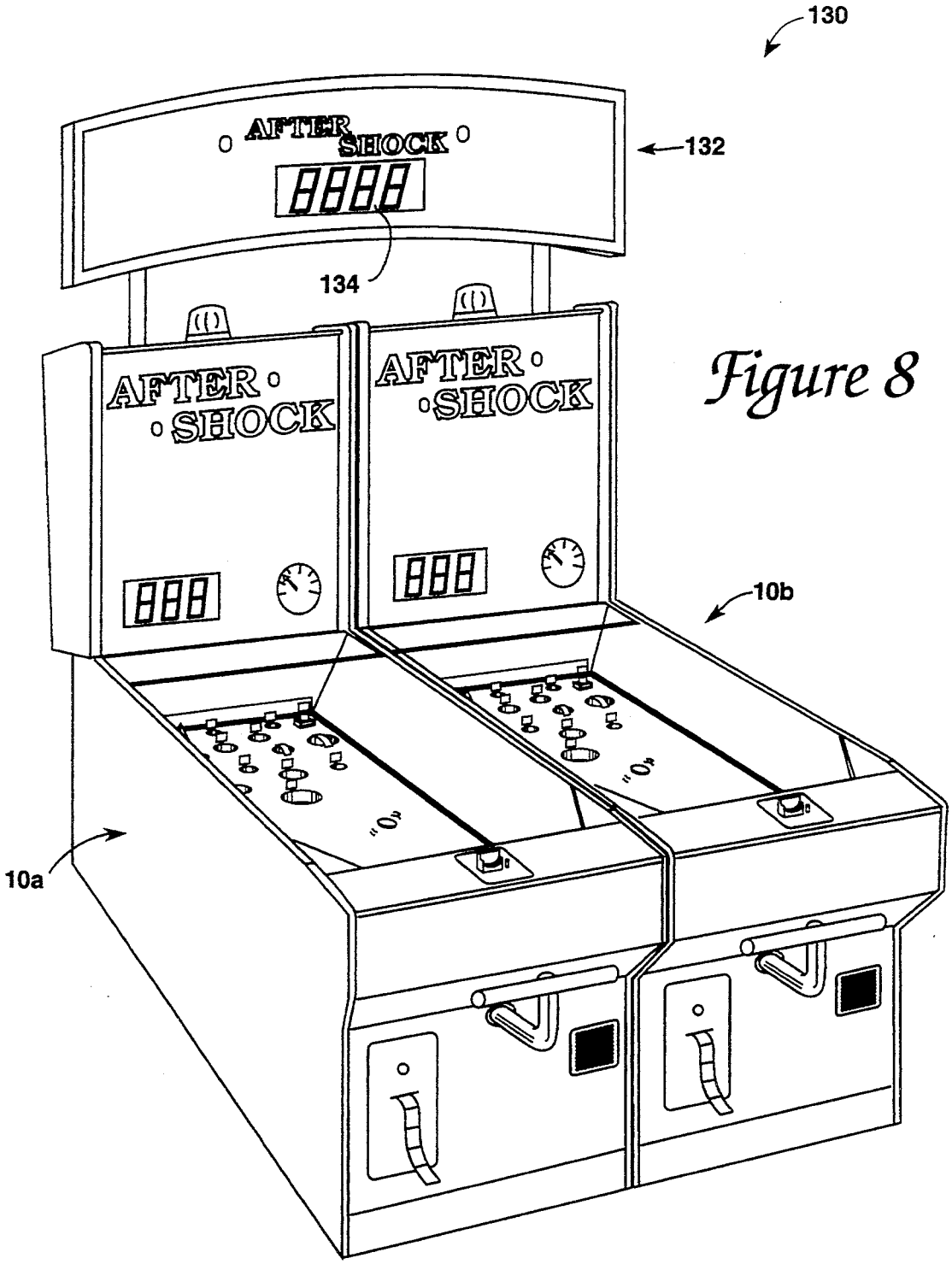
FIG. 8 is a perspective view of two individual game units connected to a progressive score display of the present invention.

FIG. 8 shows a multi-station game apparatus 130 in accordance with the present invention. The apparatus 130 includes a progressive bonus apparatus 132 with progressive score display 134 coupled to a first individual game apparatus 10*a* and a second individual game apparatus lob. Further individual game apparatus 10 may be coupled to the progressive bonus apparatus 132 as desired. Each individual game apparatus 10 has the ability to be played on its own as described in FIGS. 1–8, independent of other game apparatus 10 coupled to progressive bonus apparatus 132. In an alternate embodiment, a single individual game apparatus is coupled to progressive bonus apparatus 132, which is positioned within the individual game apparatus 10. In another alternate embodiment, a smaller progressive bonus apparatus 132 is placed over a single individual game apparatus.

Figure 9:
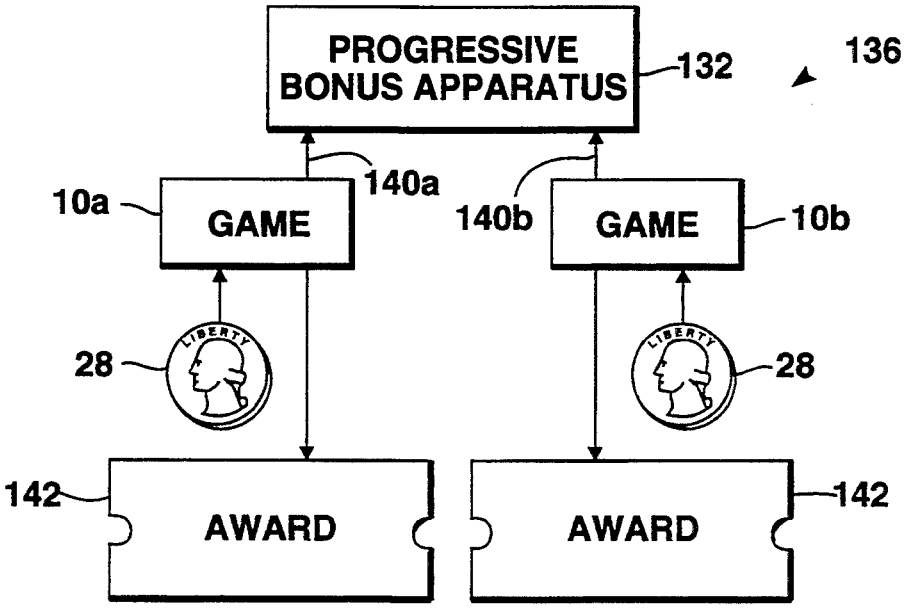
FIG. 9 is a flow chart of the progressive enhanced award process.

The process that the multi-station game apparatus 130 uses to receive money and dispense awards is illustrated in the block diagram 136 of FIG. 9. A player inserts coin 28 or other monetary input into an individual game unit 10*a* or 10*b*. Each game unit 10*a* and 10*b* is connected to the progressive bonus apparatus 132 by a data bus 140*a* and 140*b*, respectively.

The progressive bonus apparatus 132 has an output on a progressive score display 134 (see FIG. 8) which begins at a predetermined starting value. For example, the progressive score might be set at a starting score of zero. Or, so that a bonus award might be immediately available to players, the starting score could be set at a higher value.

The progressive score displayed by the progressive bonus apparatus 132 is accumulated from contributions by the individual game apparatus 10 over the data busses 140*a* and 140*b*. The contributions can be determined in a variety of ways. In the preferred embodiment, each game apparatus 10 sends a signal to the progressive bonus apparatus 132 whenever a player deposits a coin into a game apparatus 10. When the progressive bonus apparatus 132 receives this signal, it increments the progressive score by one, one-half, or another predetermined value. Thus, each game apparatus 10 that is played will increment the progressive score by this value. Other methods might be used where the game apparatus 10 sends its increment signal when a player reaches a predetermined score. Also, the progressive bonus apparatus 132 could be set to multiply the progressive score by a selected quantity whenever an individual game apparatus 10 sends an increment signal.

Each individual game apparatus 10 has one or more predetermined tasks for the player to accomplish in order for the player to receive a bonus award 142 based on the progressive score displayed by the progressive bonus apparatus 132. All game apparatus 10 that are attached to a single progressive bonus apparatus 132 preferably require the same predetermined task, so that each player competing for the progressive score has a task of the same duration and level of difficulty. This predetermined task has several possible variations. In the preferred embodiment, a player must achieve a certain high score on an individual game apparatus 10. If the player starts another game within a specific time interval from ending the last game, the player has a chance for a progressive bonus award. Progressive bonus indicator 38 on an individual game apparatus 10 can indicate how many games the player has played and how many are required to receive the progressive bonus award. In other embodiments, a player might have to finish two or more games in a row by accomplishing a different game result, such as guiding a playing piece into a small aperture or unique target.

The first player to accomplish the predetermined task is entitled to the bonus award 142 based upon the progressive score displayed on the progressive bonus apparatus 132. In the preferred embodiment, this bonus award 142 is manually given to the winning player by the owner or operator of the multi-station game apparatus 130. The bonus award 142 can be a number of normal game apparatus 10 awards: tickets, cards, etc. Such a bonus award 142 can also be dispensed to a player as follows: the progressive bonus apparatus 132 sends the progressive score data over a data bus to the winning game apparatus 10. The winning game apparatus 10 then dispenses the bonus award 142 to the player by that game apparatus's 10 normal award-dispensing means 22. In any case, once the player has won the bonus award 142, his individual game unit 10 is reset and the progressive bonus apparatus 132 is preferably reset.

Figure 10:
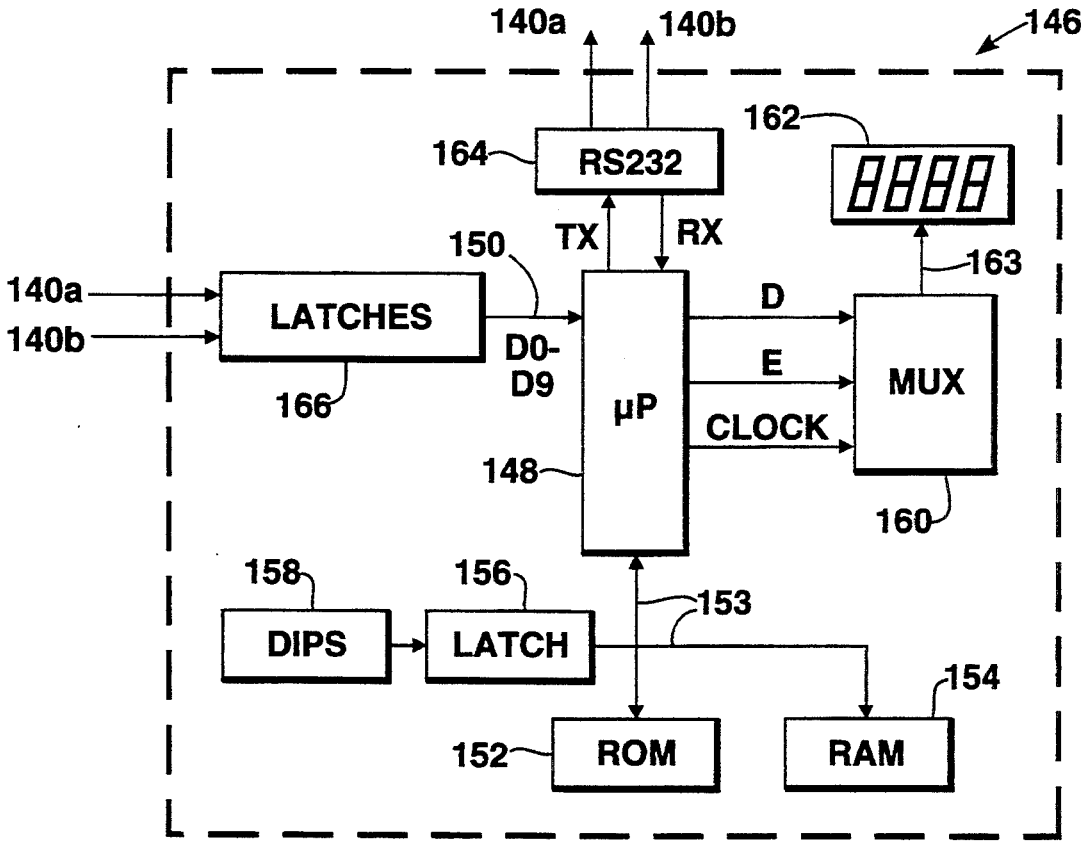
FIG. 10 is a block diagram of the microprocessor and display electronics used in the progressive bonus apparatus.

FIG. 10 is a block diagram of a control system 146 for the progressive bonus apparatus 132. The control system 146 includes a microprocessor 148, data bus 150, read-only memory (ROM) 152, random-access memory (RAM) 154, a latch 156, DIP switches 158, a multiplexer 160, an LED display 162, and an RS232 port 164.

The microprocessor 148 is preferably an 8-bit microprocessor, such as the Intel 8031, which has the range of features adequate for the task, including eight data lines and sixteen address lines. The microprocessor 148 receives data inputs D0-D9 inputs on data bus 150 from individual game apparatus that are connected to the progressive bonus apparatus 132; one data line is required per game apparatus, so a maximum of ten individual games may be connected to the progressive bonus apparatus in this embodiment. Data latches 166 are used to couple the data busses from each unit (such as data busses 140*a* and 140*b*) to the data bus 150.

The microprocessor 148 is coupled to ROM 152 by an address/control/data bus 151. The ROM 152 is preferably an erasable programmable read-only memory (EPROM) that contains the start-up instructions and operating system for the progressive bonus apparatus. Microprocessor 148 is connected to RAM 154 by the bus 153 to permit the use of RAM as scratch-pad memory.

The microprocessor 148 is also coupled to a latch 156 and DIP switches 158 by bus 153. The DIP switches 158 provide selectable functions that the owner or operator of the multi-unit game apparatus 130 may change to his or her liking. These selectable functions include setting the base payout score that the progressive bonus apparatus 132 will display in its starting state, and the increment value that the apparatus will use to increase the progressive score whenever a player achieves the predetermined task. Other selectable functions could also be set by the DIP switches depending on how many selectable game options and features are desired.

The microprocessor 148 is also coupled to a multiplexer 160. The multiplexer 160 receives a clock signal, an enable signal, and a serial LED data signal from the microprocessor 148. The multiplexer then outputs control signals to the segments of the LED display 162 on a bus 163.

The progressive bonus apparatus can also send and receive message signals through a standard RS-232 interface 164. Other interface standards, such as RS-485, can also be used. The RS-232 interface allows the control system 146 to send signals to individual game apparatus 10*a* and 10*b* over busses 140*a* and 140*b*, repectively. The RS-232 port can also be coupled to a computer system or other data processing system to allow the control and analysis of the control system 146.

The control system 146 for the progressive bonus apparatus 132 operates as follows. The microprocessor 148 first reads the low memory from ROM 152 over bus 153 and then sequences through the software instructions stored in ROM. The software from the ROM 152 instructs the microprocessor 148 to read the DIP switches 158, read in the game apparatus signals on busses 140*a* and 140*b* from the latches 166, and display or update the score LED display 162 with the information from the game apparatus signals. If a game apparatus signal on busses 140*a* or 140*b* indicates a game is over, the microprocessor 148 modifies the progressive score by the determined amount. When a game apparatus signal on busses 140*a* or 140*b* indicates that a game apparatus 10 has won the progressive bonus award, the microprocessor 148 sends signals to flash the score display and activate lights and sound speakers (not shown) indicating the bonus has been won. The owner or operator of the game apparatus 10 may then present the bonus award to the player who won it. In an alternate embodiment, the microprocessor 148 in progressive bonus apparatus 132 sends the progressive score total to the winning individual game apparatus 10 over a data bus, and the individual game apparatus 10 can then dispense the bonus award to the player.

While this invention has been described in terms of several preferred embodiments, it is contemplated that alterations, modifications and permutations thereof will become apparent to those skilled in the art upon a reading of the specification and study of the drawings It is therefore intended that the following claims include all such alterations, modifications and permutations as fall within the spirit and scope of the present invention.

What is claimed is:

1. A game apparatus comprising:

an inclined playing surface including at least one obstacle;

a playing piece adapted to frictionally engage said playing surface;

a force generating device for imparting an automatic displacement force on said playing piece, said force generating device including a vibrator coupled to said playing surface; and a user controller for varying an angle of said playing surface to direct said playing piece in a desired direction during a game in progress.

2. A game apparatus as recited in claim 1 wherein said vibrator includes an electromechanical device.

3. A game apparatus comprising:

an inclined playing surface including at least one obstacle, wherein said at least one obstacle includes at least one aperture into which said playing piece may fall;

a playing piece adapted to frictionally engage said playing surface;

a force generating device for imparting an automatic displacement force on said playing piece, said force generating device including a gas displacer operative to force a gas through said at least one aperture in said playing surface; and a user controller for varying an angle of said playing surface to direct said playing piece in a desired direction during a game in progress.

4. A game apparatus as recited in claim 3 wherein said gas displacer includes a fan and a moveable member provided with a plurality of apertures positioned between said fan and said playing surface.

5. A game apparatus comprising:

an inclined playing surface including at least one obstacle, wherein said at least one obstacle includes at least one aperture into which said playing piece may fall, said playing surface including a sensor for detecting when a playing piece has fallen into an aperture;

a controller coupled to said sensor and operative to accumulate a game score, wherein said game score is based on a pathway of said playing piece on said playing surface;

a playing piece adapted to frictionally engage said playing surface;

a force generating device for imparting an automatic displacement force on said playing piece; and a user controller for varying an angle of said playing surface to direct said playing piece in a desired direction during a game in progress.

6. A game apparatus comprising:

a playing surface defining an inclined plane;

a playing piece having a surface engagable with said playing surface;

a vibrator coupled to said playing surface which imparts a vibration force on said playing surface, said vibrator being positioned such that said playing piece does not contact said vibrator on said playing surface.

7. A game apparatus as recited in claim 6 further comprising an angular displacement mechanism coupled to said playing surface for selectively varying an angle of said playing surface.

8. A game apparatus as recited in claim 6 wherein said playing surface includes at least one obstacle positioned on said playing surface.

9. A game apparatus as recited in claim 8 wherein said at least one obstacle includes at least one aperture into which said playing piece can move.

10. A game apparatus as recited in claim 9 further comprising a plurality of apertures having at least two sizes.

11. A game apparatus as recited in claim 9 wherein said at least one aperture includes a sensor operative to detect the movement of said playing piece into said at least one aperture.

12. A game apparatus as recited in claim 11 wherein said sensor includes an optoelectronic sensor.

13. A game apparatus as recited in claim 11 further comprising a scoring device coupled to said sensor and operative to change a game score after said sensor detects said playing piece.

14. A game as recited in claim 13 further comprising a dispenser coupled to said scoring device, wherein said dispenser dispenses an award based upon said game score.

15. A game apparatus as recited in claim 13 further comprising a controller coupled to said sensor and said vibrator, said controller being operative to receive input from said sensor and to control said vibrator.

16. A game apparatus as recited in claim 9 wherein said playing piece is a substantially disc shaped.

17. A game apparatus as recited in claim 16 wherein said vibrator imparts a force on said playing surface greater than the frictional force between said playing piece and said playing surface.

18. A game apparatus as recited in claim 16 wherein said vibrator includes at least one motor coupled to said playing surface, said motor comprising a shaft having a center and at least one offset element attached to said shaft said element having a center of gravity offset from said center of said shaft.

19. A game apparatus as recited in claim 18 further comprising at least one additional offset element coupled to said shaft.

20. A game apparatus as recited in claim 19 wherein said at least two offset elements are of different weights.

21. A method for playing a game comprising:

engaging a surface of a playing piece with an inclined playing surface, said playing surface having an original position;

imparting a vibration on said playing surface; and tilting said playing surface from said original position to guide said playing piece down said playing surface.

22. A method as recited in claim 21 further comprising a step of guiding said playing piece relative to obstacles provided on said playing surface.

23. A method as recited in claim 21 further comprising a step of guiding said playing piece into at least one aperture provided in said playing surface.

24. A method as recited in claim 23 further comprising a step of sensing the passage of said playing piece through said at least one aperture.

25. A method as recited in claim 24 further comprising a step of calculating a game score after said playing piece is sensed in said at least one aperture.

26. A method as recited in claim 25 further comprising a step of dispensing an award based upon said game score.

27. A method as recited in claim 21 wherein further comprising the step of controlling a parameter of said vibration selected from the group of parameters including frequency and amplitude.

28. A method as recited in claim 21 wherein said step of tilting said playing surface is accomplished by pivoting said playing surface around an axis.

29. A game apparatus comprising:

a) at least one game unit, where each game unit includes:

i) a playing surface;

ii) a playing piece having a surface engagable with said playing surface;

iii) a vibrator coupled to said playing surface which imparts a force on said playing surface; and iv) a dispenser for dispensing awards based upon a skilled operation performed by a player of said game unit; and b) a progressive bonus apparatus coupled to said at least one game unit and operative to accumulate a progressive score based upon contributions from said at least one game unit and further operative to provide a bonus award based upon said progressive score to a player of said at least one game unit when said player accomplishes a predetermined task.

30. A game apparatus as recited in claim 29 wherein said progressive score includes the sum of said contributions from said at least one game unit.

31. A game apparatus as recited in claim 29 wherein said player accomplishes said predetermined task a plurality of times to receive said bonus award.

32. A game apparatus comprising:

a playing surface;

a playing piece adapted to frictionally engage said playing surface;

a vibrator coupled to said playing surface for imparting a vibration on said playing piece; and a user controller for varying an angle of said playing surface to direct said playing piece in a desired direction.

33. A game apparatus as recited in claim 32 wherein said vibrator includes a motor.

34. A game apparatus comprising:

a playing surface including apertures;

a playing piece adapted to frictionally engage said playing surface;

a fan and a moveable member provided with a plurality of apertures positioned between said fan and said playing surface operative to force a gas through said apertures in said playing surface to automatically displace said playing piece; and a user controller for varying an angle of said playing surface to direct said playing piece in a desired direction.

35. A game apparatus as recited in claim 34 further comprising at least one additional offset element coupled to said shaft.

36. A game apparatus comprising:

a playing surface defining an inclined plane;

a playing piece having a surface engagable with said playing surface; and a vibrator coupled to said playing surface for imparting a vibration to said playing surface, said vibrator including at least one motor coupled to said playing surface, said motor comprising a shaft having a center and at least one offset member attached to said shaft, said element having a center of gravity offset from said center of said shaft.

37. A game apparatus as recited in claim 36 wherein said at least two offset elements are of different weights.

38. A game apparatus comprising:

a playing surface defining an inclined plane;

a playing piece having a surface engagable with said playing surface, said playing piece being substantially disc shaped;

at least one obstacle positioned on said playing surface, said at least one obstacle including at least one aperture into which said playing piece can move; and a vibrator coupled to said playing surface which imparts a force on said playing surface greater than the frictional force between said playing piece and said playing surface.

39. A game apparatus comprising:

a playing surface defining an inclined plane;

a playing piece having a surface engagable with said playing surface;

at least one obstacle positioned on said playing surface, said at least one obstacle including at least one aperture into which said playing piece can move, said at least one aperture including a sensor operative to detect the movement of said playing piece into said at least one aperture;

a vibrator coupled to said playing surface for vibrating said playing surface;

a scoring device coupled to said sensor and operative to change a game score after said sensor detects said playing piece; and a controller coupled to said sensor and said vibrator, said controller being operative to receive input from said sensor and to control said vibrator.

40. A game apparatus comprising:

an inclined playing surface including at least one obstacle;

a playing piece guided by said playing surface;

means for imparting an automatic displacement force on said playing piece, said means for imparting an automatic displacement force including a vibrator coupled to said playing surface; and a user controller for varying an angle of said playing surface to direct said playing piece in a desired direction during a game in progress.

41. A game apparatus as recited in claim 40 wherein said vibrator includes a motor.

42. A game apparatus comprising:

an inclined playing surface including at least one obstacle, wherein said at least one obstacle includes at least one aperture;

a playing piece guided by said playing surface and able to fall into said at least one aperture;

means for imparting an automatic displacement force on said playing piece, said means for imparting an automatic displacement force including gas displacement means operative to force a gas through at least one aperture in said playing surface; and a user controller for varying an angle of said playing surface to direct said playing piece in a desired direction during a game in progress.

43. A game apparatus as recited in claim 42 wherein said gas displacement means includes a fan and a moveable member provided with a plurality of apertures positioned between said fan and said playing surface.

* * * * *